US009601047B2

(12) United States Patent
Miller et al.

(10) Patent No.: US 9,601,047 B2
(45) Date of Patent: Mar. 21, 2017

(54) METHOD FOR DIMMING ELECTROLUMINESCENT DISPLAY

(75) Inventors: Michael E. Miller, Honeoye Falls, NY (US); Christopher J. White, Avon, NY (US)

(73) Assignee: Global OLED Technology LLC, Herndon, VA (US)

( * ) Notice: Subject to any disclaimer, the term of this patent is extended or adjusted under 35 U.S.C. 154(b) by 2088 days.

(21) Appl. No.: 12/271,321

(22) Filed: Nov. 14, 2008

(65) Prior Publication Data

US 2010/0123651 A1 May 20, 2010

(51) Int. Cl.
*G09G 3/32* (2016.01)
*G09G 3/34* (2006.01)

(52) U.S. Cl.
CPC ... *G09G 3/3208* (2013.01); *G09G 2300/0452* (2013.01); *G09G 2320/046* (2013.01); *G09G 2320/066* (2013.01); *G09G 2320/103* (2013.01); *G09G 2330/045* (2013.01); *G09G 2360/16* (2013.01)

(58) Field of Classification Search
USPC ..... 315/151, 169.3, 360; 345/20, 32, 77, 89, 345/102, 204, 690; 348/155, 254, 675, 348/687, 634; 353/94; 356/437; 358/538; 375/240.22; 382/103, 170, 190, 382/254, 274; 396/382; 710/1
See application file for complete search history.

(56) References Cited

U.S. PATENT DOCUMENTS

| | | | | |
|---|---|---|---|---|
| 4,338,623 | A | 7/1982 | Asmus et al. | |
| 6,313,878 | B1 | 11/2001 | Jankowiak | |
| 6,856,328 | B2 | 2/2005 | Holtslag | |
| 7,826,640 | B1 * | 11/2010 | Yao et al. | 382/103 |
| 2003/0016881 | A1 * | 1/2003 | Matsuura | 382/274 |
| 2005/0066068 | A1 * | 3/2005 | Karaoguz et al. | 710/1 |
| 2005/0184926 | A1 * | 8/2005 | Wada et al. | 345/32 |
| 2005/0237002 | A1 * | 10/2005 | Nakamura | 315/169.3 |
| 2006/0055829 | A1 * | 3/2006 | De Haan | 348/675 |
| 2006/0056023 | A1 * | 3/2006 | Malfait et al. | 359/472 |
| 2006/0209005 | A1 * | 9/2006 | Pedram et al. | 345/102 |
| 2008/0068359 | A1 * | 3/2008 | Yoshida et al. | 345/204 |

(Continued)

FOREIGN PATENT DOCUMENTS

WO 2006/103629 3/2006

*Primary Examiner* — Lin Li
(74) *Attorney, Agent, or Firm* — Global OLED Technology LLC

(57) ABSTRACT

A method for controlling an electroluminescent display to produce first and second images for display wherein the second image has reduced luminance to reduce burn-in on the display, includes providing the electroluminescent (EL) display having a plurality of EL emitters, the luminance of the light produced by each EL emitter being responsive to a respective drive signal; receiving a respective input image signal for each EL emitter for each of a plurality of frames; transforming the input image signals for a first frame to provide a plurality of first drive signals to produce an image on the display; and transforming the input image signals for a second frame to a plurality of second drive signals using a dimming transform that operates on the input image signals for each frame to provide a peak frame luminance value for the second frame wherein the dimming transform includes an exponential function.

2 Claims, 8 Drawing Sheets

(56) References Cited

U.S. PATENT DOCUMENTS

| | | | | |
|---|---|---|---|---|
| 2008/0116827 | A1* | 5/2008 | Williams | 315/360 |
| 2008/0150971 | A1* | 6/2008 | Kienhoefer | 345/690 |
| 2009/0046205 | A1* | 2/2009 | Strasser et al. | 348/634 |
| 2010/0080459 | A1* | 4/2010 | Dai et al. | 382/170 |

* cited by examiner

METHOD FOR DIMMING ELECTROLUMINESCENT DISPLAY

CROSS REFERENCE TO RELATED APPLICATION

Reference is made to commonly-assigned, co-pending U.S. patent application Ser. No. 12/271,355, filed concurrently herewith entitled "Tonescale Compression For Electroluminescent Display" by Miller et al, the disclosure of which is incorporated by reference herein.

FIELD OF THE INVENTION

The present invention relates to electroluminescent display systems. Particularly, the present invention provides a method for rapidly dimming an electroluminescent display while in a visually indistinguishable manner. Further embodiments are provided which maintain shadow detail.

BACKGROUND OF THE INVENTION

Many display devices exist within the market today. Among the displays that are available are thin-film, coated, electroluminescent (EL) displays, such as organic light-emitting diode (OLED) displays. These displays can be driven using an active matrix or passive matrix back plane. Regardless of the technology that is applied, these display devices are typically integrated into a system that involves a controller for receiving an input image signal, converting the input image signal to an electronic drive signal and supplying the electronic drive signal to the electroluminescent display device which drives an array of emitters to produce light in response to the drive signal.

Unfortunately, as these emitters convert current to light they typically degrade and this degradation is a function of the current that is provided to each emitter. As such, the emitters that receive the most current degrade at a faster rate than emitters that receive less current. As the emitters degrade, they produce less light as a function of current. Therefore each emitter will likely have a different amount of degradation and this difference in degradation results in differences in luminance when the emitters are driven with the same current to produce a uniform image. As a result, inadvertent patterns are created when the display is turned on due to this difference in luminance uniformity. These patterns can be distracting and cause the display to be perceived by the end user as low in quality or, under extreme conditions, unusable.

Fortunately, in many applications, such as when displaying motion video, the image content is constantly changing and the current to every emitter is varied as a function of the image content. Therefore, the amount of current is relatively balanced across the emitters of the display over time and the differences in degradation and hence differences in luminance when displaying a uniform image is balanced, making this problem a non-issue. In the event that the video is paused or a single static image is displayed, the quality of the display can be degraded because the pattern of currents across the display are stationary with respect to the array of emitters.

This problem is not unique to OLED but instead arises in all known emissive displays, including CRTs and plasma displays, and can be exhibited by non-emissive displays, such as liquid crystal displays. One method that has been demonstrated to reduce this problem in the prior art is to detect the presence of a static image and reduce the peak luminance and therefore the current through each emissive display element in the display.

As an example of prior art for reducing the peak luminance, Asmus et al. in U.S. Pat. No. 4,338,623, discusses a CRT display which includes a circuit for detecting a static image and a circuit for protecting the display by decreasing the brightness of the displayed image by decreasing the voltage at the cathode of the CRT. While this method satisfies the requirement that it will reduce the image stick artifact, the method provides a very rapid change in luminance, which will be quite noticeable to the user and by controlling the analog circuit in this fashion, there is little control of the appearance of the image after its luminance is reduced.

Similarly Jankowiak in U.S. Pat. No. 6,313,878, discusses a system which sums the red, green, and blue component signals in an input digital signal to detect the presence of a static image and then produces an analog signal to adjust a video gain on the display to reduce the luminance of the display in response to a static image. Once again, the method permits static images to be dimmed, however, by changing the gain value, there is little ability to control the appearance of the final image after its luminance is reduced.

Holtslag in U.S. Pat. No. 6,856,328, discusses detecting static regions in an image and reducing the intensity of only these areas in the image. Holtslag also discusses reducing the light intensity in a stepwise fashion to reduce the visibility of the change in luminance of the display. However, Holtslag does not provide a detailed description of the method used to reduce visibility.

Ekin in WO 2006/103629, acknowledges that by simply dimming the display using methods, such as described by Asmus, Jankowiak or Holtslag, important image data can become invisible to the user. Ekin proposes a very complex solution to this problem that involves performing object detection to detect individual objects in a scene, calculating the contrast between the luminance of these objects and then reducing the luminance of these objects in a way as to maintain at least a minimum contrast between these objects in the scene. Unfortunately, the implementation of algorithms for object detection within a display driver is prohibitively expensive and does not provide a practical solution to maintaining the quality of the image as the luminance of the display is reduced to avoid image stick. Further, such methods are very difficult to employ in natural images, which have nearly continuous tonal levels and it is impossible to maintain adequate contrast between every tonal level such that the difference in tonal levels are visible.

Sony has recently marketed an OLED television referred to as the XEL-1. This display detects the presence of a static image and dims the display in the presence of a static image. This dimming is performed slowly so that the user is not aware that it is occurring. Radiometric measurements indicate that the decrease in luminance is linearly related to time within distinct portions of the luminance decrease function, however, this function includes several distinct portions, some with a slope of zero and some with a linear slope greater than zero. Further, the images constantly lose shadow detail as the image is dimmed. Photometric assessment of this display shows that dimming such that the luminance is reduced by a constant ratio for all luminance values.

It is desirable to provide a method of dimming an EL display in a way that the user is unaware of the fact that the image is being dimmed. However, it is also important that the display dim as rapidly as possible to minimize the opportunity for image burn-in. Further, it is desirable that the image is dimmed in a way that information is not lost as the image is dimmed.

SUMMARY OF THE INVENTION

It is therefore an object of the present invention to produce an image at a different luminance value during different time intervals when a static image region is provided. The reduction in luminance value should be achieved as rapidly as possible without being visibly detected to minimize burn-in without introducing visible artifacts. This is achieved by a method for controlling an electroluminescent display to produce first and second images for display wherein the second image has reduced luminance to reduce burn-in on the display, comprising:

(a) providing the electroluminescent (EL) display comprising a plurality of EL emitters, the luminance of the light produced by each EL emitter being responsive to a respective drive signal;

(b) receiving a respective input image signal for each EL emitter for each of a plurality of frames;

(c) transforming the input image signals for a first frame to provide a plurality of first drive signals to produce an image on the display; and (d) transforming the input image signals for a second frame to a plurality of second drive signals using a dimming transform that operates on the input image signals for each frame to provide a peak frame luminance value for the second frame wherein the dimming transform includes an exponential function, whereby the second frame has reduced luminance to reduce burn-in.

The present invention provides a low cost method for rapidly manipulating the luminance of a display. This method permits the luminance of a display to be manipulated over a large range without a significant loss in image quality, enabling more rapid and larger dimming changes. By dimming EL displays in this way, the likelihood of image stick and power is reduced. In some embodiments, this is achieved without reducing the detail within a shadow range of the displayed images. The present invention recognizes that the human eye responds to light and adapts as a logarithmic detector. By better matching the dimming function of the display to the adaptation curve of the human eye, more rapid dimming can be implemented without the introduction of visible artifacts. Further, this invention recognizes that information is lost when dimming displays to reduce image stick because the function relating input to output luminance is typically linear while the human eye responds to light as a logarithmic detector and therefore adjusts the contrast of the image as the luminance of the display is reduced to provide a higher quality image and to further reduce burn-in.

DETAILED DESCRIPTION OF THE INVENTION

Figure 1:
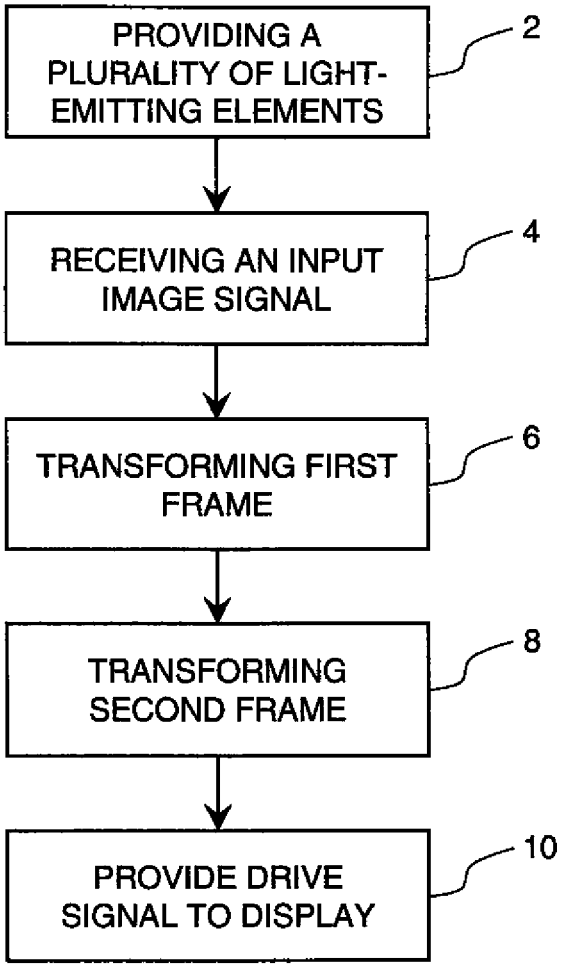
FIG. 1 is a flow chart showing the steps of a method of the present invention.

The need is met by providing a method for controlling an electroluminescent display to produce first and second images for display wherein the second image has reduced luminance to reduce burn-in on the display. As shown in FIG. 1, an electroluminescent (EL) display is provided 2 including a plurality of EL emitters, the luminance of the light produced by each EL emitter being responsive to a respective drive signal. A respective input image signal is received 4 for each EL emitter for each of a plurality of frames. The input image signals for a first frame are transformed 6 to provide a plurality of first drive signals to produce an image on the display. Further, the input image signals for a second frame are transformed 8 to a plurality of second drive signals using a dimming transform that operates on the input image signals for each frame to provide a peak frame luminance value for the second frame wherein the dimming transform includes an exponential function, whereby the second frame has reduced luminance to reduce burn-in. The drive signals are provided 10 to the display to drive the display.

Figure 2:
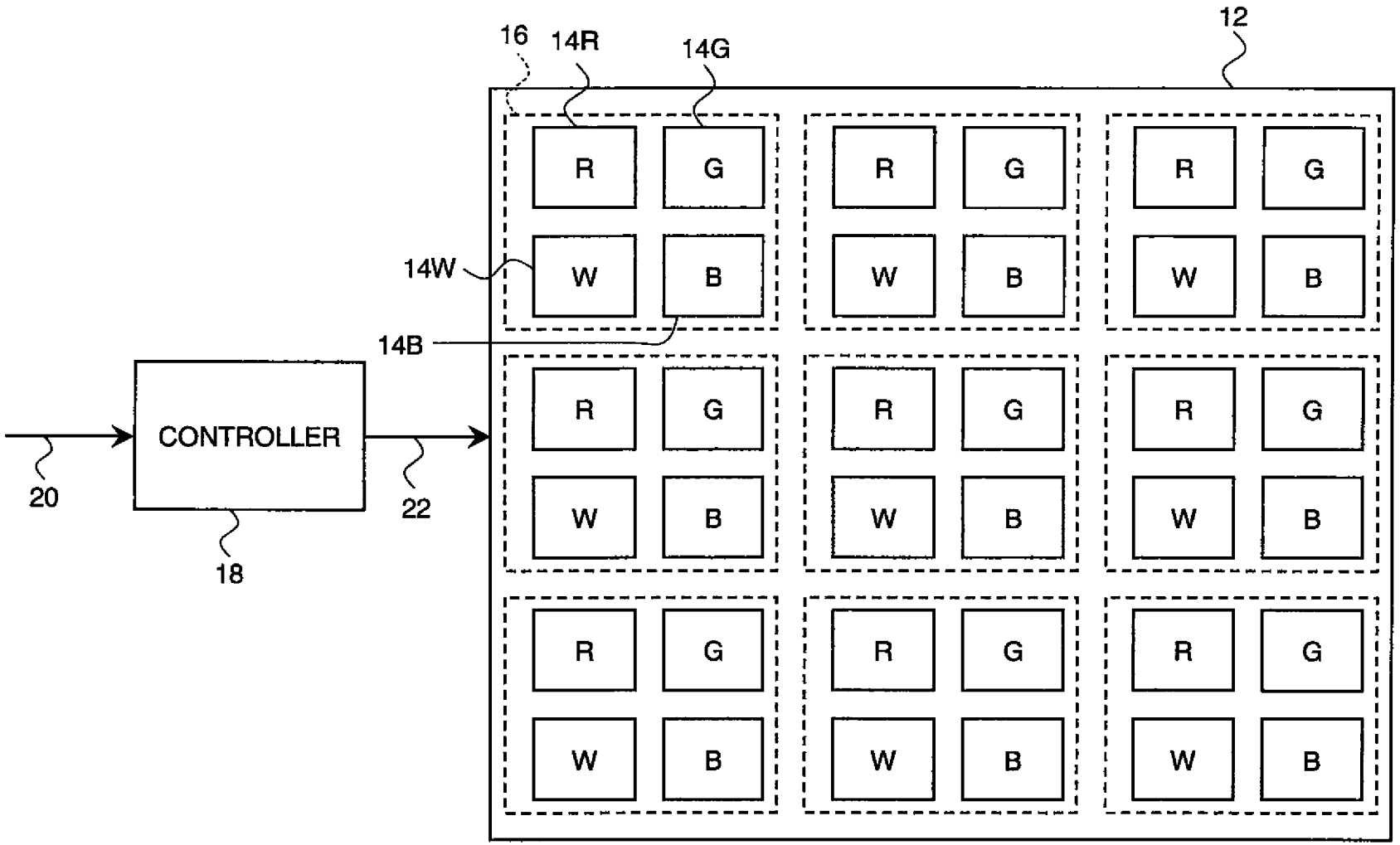
FIG. 2 is a schematic diagram of a system useful in practicing the present invention.

Referring to FIG. 2, an EL display system has an EL display 12, which has an array of EL emitters such as 14R, 14G, 14B, and 14W for producing light in response to a drive signal. This array of emitters can include pixels 16 which are formed from repeating patterns of EL emitters for producing different colors of light. For example, this array of EL emitters can include repeating patterns of red 14R, green 14G, blue 14B and white 14W EL emitters, wherein each combination of these EL emitters are capable of forming a color image. The array of EL emitters can alternatively include individual EL emitters which all produce the same color of light or any number of differently colored EL emitters for producing different colors of light. The EL display system can further include a controller 18. The controller 18 receives an input image signal 20 for each EL emitter, processes the input image signal 20, and provides a drive signal 22 to the EL emitters 14R, 14G, 14B, 14W of the EL display 12.

In this system, the controller 18 processes the input image signal 20 to provide a plurality of first drive signals for driving each of the EL elements within a first frame and also to provide a plurality of second drive signals for driving each of the EL elements with a reduced luminance on the EL display 12 during a second frame. The controller 18 can additionally process the input image signal 20 to provide the second drive signals such that the luminance decrease in the shadow range is less than the luminance decrease in the non-shadow range.

Figure 3:
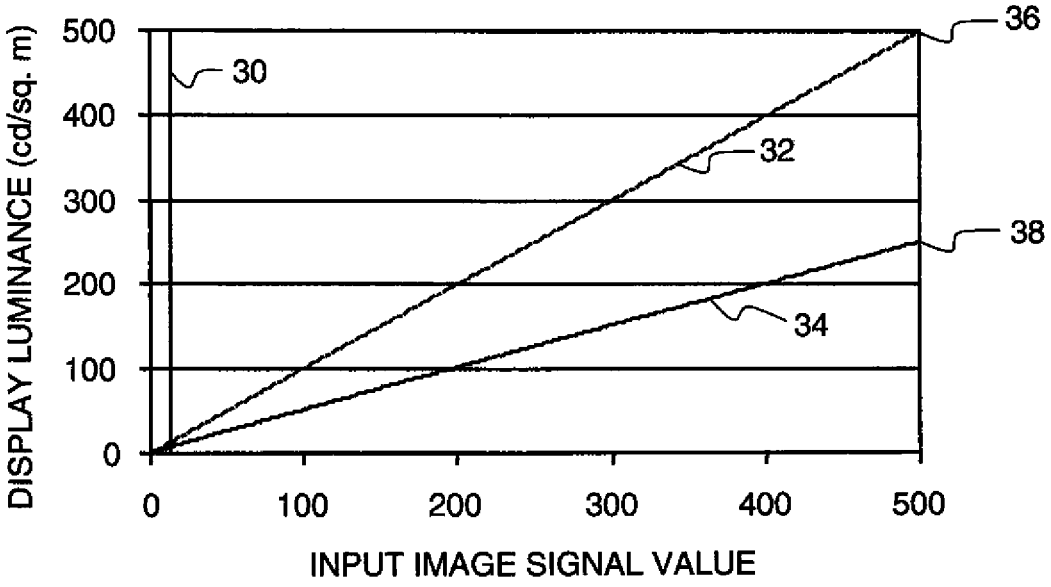
FIG. 3 is a graph showing a first and a second distribution of luminance values according to an embodiment of the present invention.

Referring to FIG. 3, there is shown an example of the input-output relationship of the controller, hereinafter referred to as a "contrast function." The abscissa represents input image signal values from 0 to 500. The ordinate represents the luminance provided by the EL display 12 in response to the drive signal 22. As shown, the EL display 12 is assumed to be capable of providing a maximum display luminance of 500 cd/m$^2$. For example, during the first frame, the input-output relationship function can be a linear contrast function 32.

Within the context of the present invention, a frame refers to a single input image signal for each subpixel, permitting update all of the drive signals necessary to provide a single refresh of the EL elements on the EL display 12, and to the corresponding drive signals. Each frame of the input image signal is displayed with a corresponding peak frame luminance value. This peak frame luminance value can represent the luminance produced by a display driven with a drive signal value corresponding to a maximum input image signal value. For the linear contrast function 32, the peak frame luminance value 36 is 500 cd/m$^2$. In this example, point 36 is also the maximum display luminance value: the maximum luminance the display can produce, as configured and under selected conditions. The peak frame luminance value is thus always less than or equal to the maximum display luminance value. In one embodiment, while reducing the peak frame luminance value below the maximum display luminance value, the present invention can maintain shadow detail.

The controller 18 further processes the input image signals 20 for a frame to produce a drive signal 22 during a second time interval. For example, contrast function 34 can be applied to a second frame of the input image signal. A peak frame luminance value 38 (250 cd/m$^2$) of contrast function 34 is lower than the peak frame luminance value 36 (500 cd/m$^2$) of linear contrast function 32. The peak frame luminance for each frame can be selected using a dimming transform that operates on the input image signals for each frame. The dimming transform can include an exponential function.

In FIG. 3, a demarcation line 30 separates the shadow range of the input image signal values from the non-shadow range of the input image signal values. The luminance values generated in response to input image signal 20 values at or below the demarcation line (in the shadow range) are transformed such that they are reduced by a first proportion, and the input image signal 20 values above the demarcation line (in the non-shadow range) are reduced by a second, smaller proportion.

Figure 4:
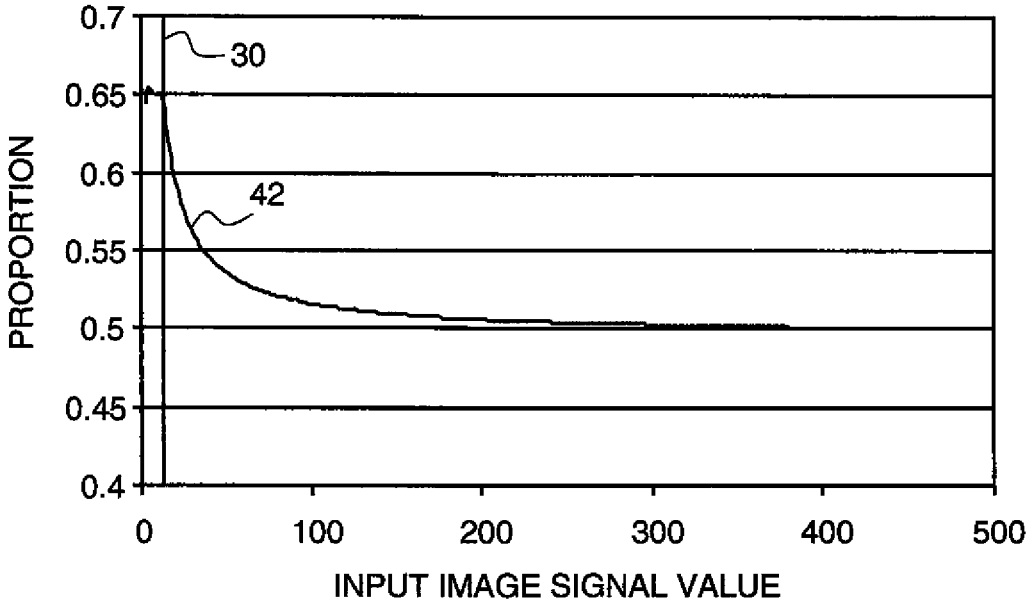
FIG. 4 is a graph showing the ratio of the second distribution to the first distribution shown in FIG. 3.

FIG. 4 shows a proportion 42 that is obtained by dividing contrast function 34 in FIG. 3 by the linear contrast function 32, with the y-axis of this figure representing the proportion 42 and the x-axis of this figure representing the input image signal value. As shown, this proportion 42 is near 0.65 for very low input image signal values and decreases to near 0.5 for larger input image signal values. This proportion 42 follows a nonlinear curve with the largest proportions occurring for input image signal values corresponding to display luminance values of 10% or less of the peak frame luminance. By using a larger proportion 42 for smaller input image signal values than for larger input image signal values, the luminance is reduced less in the shadow range (i.e., the range having a low relative luminance) of resulting images than in the non-shadow range. If the human eye responded linearly to this change in luminance, the shadow range of the image would appear brighter and the remainder of the image would be reduced in contrast. However, because the human eye is a logarithmic detector, this method maintains the shadow detail in an image that would otherwise be lost while maintaining acceptable contrast throughout the remainder of the image.

The present invention has displayed images rendered using contrast functions 32 and 34 on an OLED display and determined that the use of a variable proportion as a function of luminance value wherein the proportion is higher for low luminance values than for high luminance values results in an image with superior image quality and clearer shadow detail than is obtained using a fixed proportion. This experiment also demonstrates, however, that if the proportion is too large or if values are increased for more moderate display luminance values, the image loses apparent contrast and objects, especially faces, lose perceived color saturation. Therefore, it is preferable that the shadow range be defined as input image signal values corresponding to <=20% of the peak frame luminance values, and more preferably <=10% of the peak frame luminance values.

Figure 5:
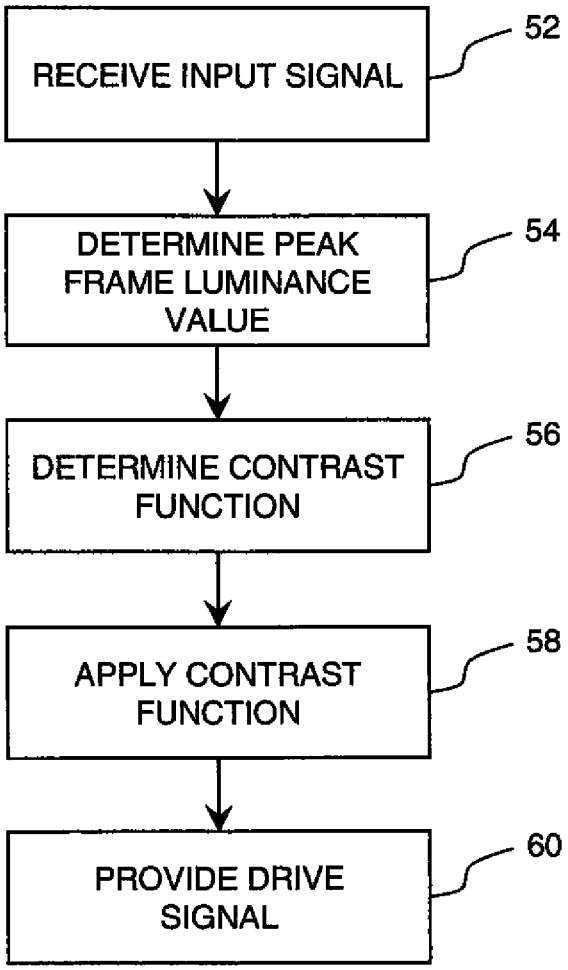
FIG. 5 is a flow chart showing the steps of an image processing method of the present invention.

Referring to FIG. 5, according to one embodiment of the present invention, to increase the visibility of objects in the shadow region, the controller 18 can receive 52 an input image signal 20 having a defined maximum intensity value. The controller 18 determines 54 a peak frame luminance value. The controller 18 then determines 56 a contrast function, a transform mapping the input image signal to a drive signal as a function of the peak frame luminance value. The controller then applies 58 the contrast function to the input image signal to obtain an output image signal. The controller then provides 60 a drive signal 22 to the display that is based upon the output image signal.

The contrast function can preferably be a nonlinear function for reducing the input image signal for input image signal values larger than those corresponding to 0.2 times the peak frame luminance value by a first proportion and reducing the input image signal values corresponding to luminance values less than 0.05 times the peak frame luminance value by at least a second proportion, which is larger than the first proportion.

According to the present invention, the peak frame luminance value will be determined 54 using a dimming transform that operates on the input image signals for each frame to provide a peak frame luminance value for the second frame wherein the dimming transform includes an exponential function. However, this peak frame luminance value can be dependent upon a number of factors. For example, a peak frame luminance value can be determined based upon an estimate of the current required to present an input image signal 20 with no reduction in peak frame luminance. If this required current is too high, the peak frame luminance value can be decreased. As such, the method will include recognizing when the input image signal requires a current above a defined current threshold and transforming 8 a frame of the input image signal using a dimming transform that operates on the input image signals for each frame to provide a peak frame luminance value for the second frame wherein the dimming transform includes an exponential function to reduce the peak frame luminance value. One method for determining the need for current reduction has been described in U.S. Patent Application Publication No. 2007/0146252 by Miller et al.

In another method for determining 54 the peak frame luminance value, the value can be computed based upon the response from a thermometer that provides an estimate of the temperature of the display. This method could decrease the peak frame luminance value in response to rapidly-increasing or high temperature values. As such, the method would recognize when the temperature of the EL display device exceeds a defined temperature threshold value and transforming 8 a frame of the input image signal using a dimming transform that operates on the input image signals for each frame to provide a peak frame luminance value for the second frame wherein the dimming transform includes an exponential function to reduce the peak frame luminance value.

In one embodiment of the present invention, the peak frame luminance value can be determined based upon the time that a static image is presented on the EL display 12. That is, the method can include recognizing when the input image signal represents a static image and transforming 8 a frame of the input image signal using a dimming transform that operates on the input image signals for each frame to provide a peak frame luminance value for the second frame wherein the dimming transform includes an exponential function to reduce the peak frame luminance value. Further, it is not necessary that the entire image be static as the method can determine the presence of a static portion of the displayed image, for example, a title bar and apply the dimming function in response to an indication of this inactive display region. The peak frame luminance value can alternatively be determined based upon a combination of two or more of the factors, including current, temperature, or static images or other additional factors. Further, sensors for determining temperature, current, or the presence of a static image region can be employed to provide a control signal and the dimming function can be applied in response to one or a combination of these control signals.

Figure 6:
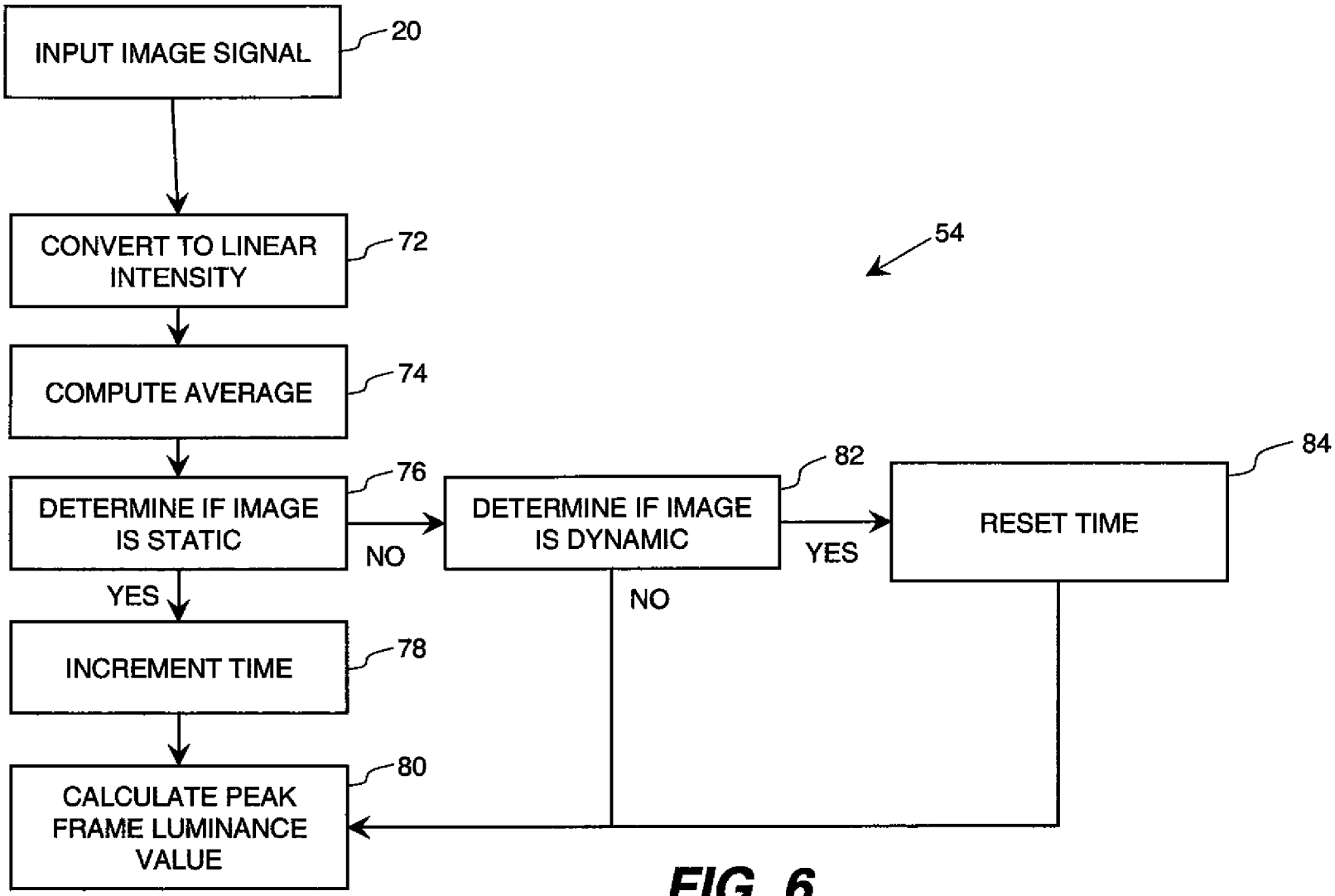
FIG. 6 is a flow chart showing a method for calculating a dimming function.

To provide a specific example, the controller 18 can determine 54 the peak frame luminance value based upon the time that a static image is presented on the display by applying the steps shown in the flow chart of FIG. 6. As shown in FIG. 6, the input image signal 20 is converted 72 into linear intensity values, for example using a nonlinear scaling and a matrix rotation according to a display standard such as ITU-R BT.709.

The average linear intensity value will then be computed 74 for each frame of data in the input image signal. The average linear intensity value is compared to an average linear intensity value for a previous frame in the input image signal. Through this comparison, it will be determined 76 if the image is static. If there is very little change (typically less than 1% change) in the average intensity value between the previous and present frame of data, a static image can be assumed.

If the image is determined to be static, the time that the image has been static is incremented 78. Generally, this step simply involves incrementing a counter, indicating the number of static frames since the last time motion was detected in the scene. However, the counter can be incremented based upon other factors. For example, the average value computed in step 74 might be summed with average values for previous frames and a counter incremented only after this sum reaches a threshold. As such the dimming function is applied in response to a control signal, wherein the control signal responds to a change in a timer, which is initiated in response to the detection of a static image A peak frame luminance value is then calculated 80. This peak frame luminance value will typically be dependent upon the status of the counter that was incremented during step 78. This peak frame luminance value can be determined based upon the following equations:

$$L_f = L_d \times A(f) \quad \text{(Eq. 1)}$$

$$A(f) = \begin{cases} M & \text{for } f < i \\ M * ((1 - h_s)k_s^{(f-i)} + h_s) & \text{for } f >= i \text{ and } f <= F_s \\ M * \left((A(F_s) - h_t)k_t^{((f-i)-(F_s+1))} + h_t\right)_s & \text{for } f > F_s \end{cases} \quad \text{(Eq. 2)}$$

In Eq. 1, $L_f$ is the peak frame luminance (e.g. 38 of FIG. 3). $L_d$ is the maximum display luminance value (e.g. 36). A(f) is proportion of maximum luminance which is >=0 and <=1. In Eq. 2, M is a selected maximum proportion, for example 1. The value f is the time that was incremented in step 78. This value is typically incremented as each frame of data is input and therefore this value will typically indicate the number of static frames since the last motion frame was detected in the input image signal value. In practice, this equation implements a function that permits the maximum peak frame luminance to be held constant for i frames after a static image is displayed. The maximum peak frame luminance is then decreased as an exponential function of the additional time up until $F_s$. Once $F_s$ is achieved, the maximum peak frame luminance is decreased as the function of a second exponential function. The values $k_s$ and $k_t$ represent constants between 0 and 1, which control the sharpness of the each of the two exponential functions. The values $h_s$ and $h_t$ represent the minimum value that each of the exponential values can attain. By applying this function, the dimming transform is a multi-part function. Further this multi-part function provides a dimming function, which includes a constant function (i.e., M) and a plurality of exponential functions.

Figure 7:
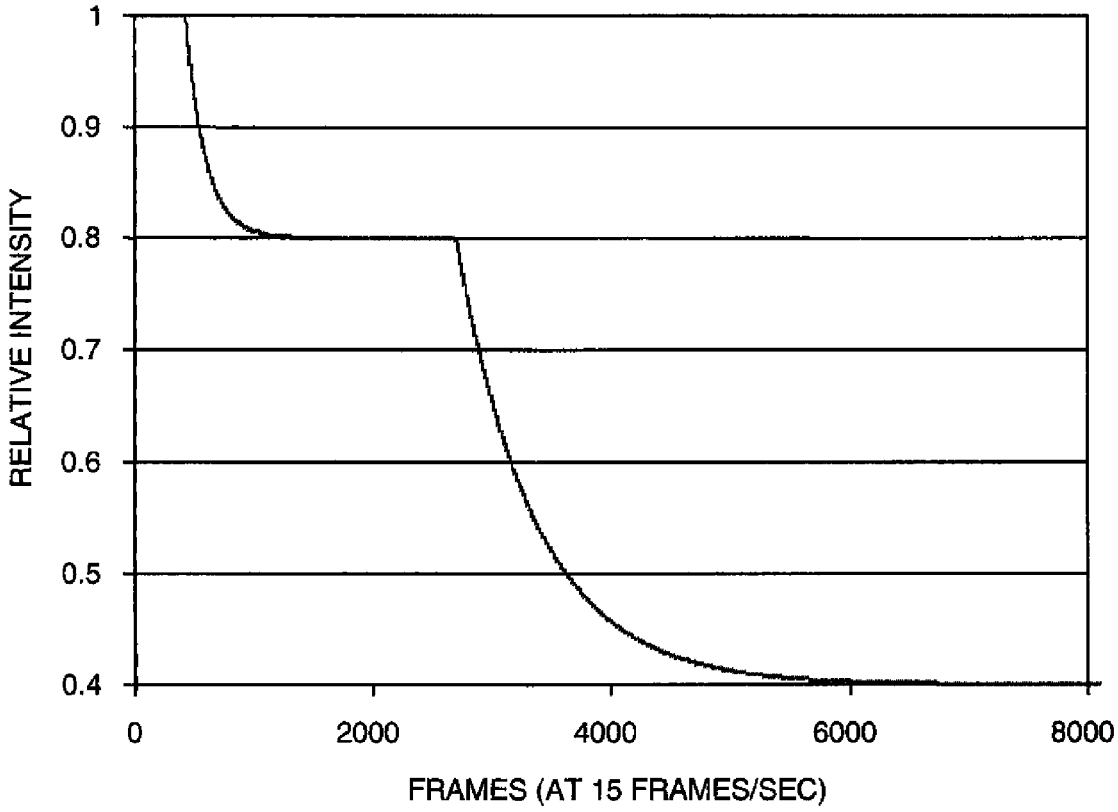
FIG. 7 is a graph showing a dimming function of the present invention.

These functions will ideally include large enough values for $k_s$ and $k_t$ such that the luminance of the image is decreased very gradually as a function of the time that a static image is displayed. If these values are too large, the user will see the luminance of the display reduced. However, it has been observed that because the human eye adapts following similar exponential functions that the rate at which the display can be dimmed can be faster when using exponential functions than when using linear functions as are known in the art. For a typical OLED having a peak luminance of around 200 cd/m$^2$, the values in Table 1, were found to create desired behavior from experimental display systems having different frame rates. The proportion of maximum luminance as a function of time that a static image is displayed is shown in FIG. 7 using this function, referred to as the dimming transform. As can be seen, the function provides a constant luminance for the first few hundred frames after which the proportion of maximum luminance decreases to a first plateau at 0.8 and then a second plateau at 0.2.

TABLE 1

| | Frame rate | | |
|---|---|---|---|
| | 15 Hz | 30 Hz | 60 Hz |
| $k_s$ | 0.994 | 0.997 | 0.9985 |
| $k_t$ | 0.9985 | 0.9993 | 0.9997 |
| $h_s$ | 0.8 | 0.8 | 0.8 |
| $h_t$ | 0.4 | 0.4 | 0.4 |
| $F_s$ | 2700 | 5400 | 10800 |

In the method as described, the aim intensity is determined by first determining the presence of a static image as discussed in step 76, determining a number of increments over which the static image is displayed as performed in step 78 and computing the proportion of maximum luminance and the corresponding peak frame luminance value as a multi-part function of the number of increments which is performed in the calculate peak frame luminance value of step 80. As described, this multi-part function includes at least one exponential function, specifically two exponential functions and an initial delay function, which delays the onset of reducing the aim intensity value.

Returning to the discussion of FIG. 6, if a static image is not determined to exist, the average computed in step 74 for a frame is compared to the average for a previous frame to determine 82 if the image is dynamic (or undergoing motion). If the difference is not sufficiently large (i.e. not greater than 1%), the image is not found to be dynamic. Under this condition, the timer can maintain a constant value or it might be incremented. If the image is determined 82 to be dynamic, the time can be reset 84 to zero and the peak frame luminance value calculated 80 to reset the proportion of maximum luminance to its maximum value, for example 1. By calculating 80 the peak frame luminance value in FIG. 6, the peak frame luminance value in FIG. 5 is determined 54.

A contrast function can then be determined 56. This contrast function will ideally be continuous and smooth as a function of both input image intensity value and the peak frame luminance value. This function could be implemented by transforming the input image signal that was received 52 into a logarithmic space, performing a linear manipulation and converting from the logarithmic space to linear intensity. By performing such a manipulation, the contrast function will provide a nonlinear function for reducing the input image signal for input image signal values larger than 0.2 times the maximum intensity value by a first proportion and reducing the input image signal for input image signal values less than 0.05 times the maximum intensity value by at least a second proportion, which is larger than the first. This method will provide the desired function but is generally expensive to implement in an FPGA or ASIC. An alternative would be to form a family of power functions with each power function corresponding to different aim intensity. However, this approach can again be expensive to implement within an FPGA or ASIC. By applying approaches, such as these, the step of transforming 8 second frame will include using a contrast function while simultaneously using the dimming function for converting the input image signals to the plurality of second drive signals so as to maintain contrast in the displayed image while reducing burn-in by adjusting the drive signals to have reduced luminance provided by each pixel with the luminance decrease in the shadow region being less than the luminance decrease non-shadow regions.

A less expensive approach to achieve a similar result is to use a two-part curve that includes both a portion of a parabolic function, providing a nonlinear transform for low code values, and a linear transform for higher code values. Such a function can enable the EL emitters of the display to produce a peak frame luminance value wherein the contrast function is linear for luminance values greater than 20% of the peak frame luminance value and nonlinear for values less than 5% of the peak frame luminance value. As such, the contrast function includes a first and second sub-function. The first sub-function is used to transform input image signals in the shadow range and the second sub-function is used to transform input image signals in the non-shadow range. Therefore, the first sub-function can be a quadratic polynomial and the second sub-function can be linear.

Such two-part functions are generally not desirable for such contrast functions since any discontinuity between the two sub-functions can result in significant imaging artifacts, such as contouring. However, these two sub-functions can be combined since the parabolic function provides a large number of instantaneous slopes. If the line is tangent to the parabola, the instantaneous slope of the parabola at the connection point will match the slope of the line, avoiding any discontinuity. As such by applying these two sub-functions both the contrast function and its first derivative are continuous.

The step of determining 54 peak frame luminance value can provide a proportion of the maximum luminance. This proportion will decrease over time when a static image is displayed and can be any value between 1 and a proportion greater than zero. This proportion defines the peak frame luminance value by defining the drive signal at an input image intensity value of 1, defining one point on the linear portion of the function (denoted as $x_1$, $y_1$). This point provides the maximum output image intensity value.

In the current transform, the parabolic portion of the tone scale will be constrained to intersect the origin of the desired transform relating input image intensity to output image intensity and is constrained to provide positive output image intensity values in response to positive input intensity values. This constraint limits the parabola to equations of the form:

$$Y_{parab}=ax^2+bx. \quad \text{(Eq 3)}$$

The present invention has determined parabolas of this form provide visually-acceptable contrast function. With these constraints and having known values for a and b, it is possible to determine the slope of the linear portion, the coordinates of the tangent point and an offset for the linear portion. Having this function, all parameters for a contrast function composed of a parabolic sub-function and a linear sub-function can be computed. However, these parameters are not fixed but instead can be varied as a function of the peak frame luminance value to permit the display to be dimmed smoothly among peak frame luminance values while varying the shape of the contrast function as a function of the peak frame luminance value. As such the contrast function varies as a function of the peak frame luminance value. A range of parameter values can be stored in a lookup table (LUT), or computed. The use of these functions for a and b permit relatively significant changes in the perceived luminance of the shadow range to be provided without losing saturation or contrast within areas of an image containing flesh.

Figure 8:
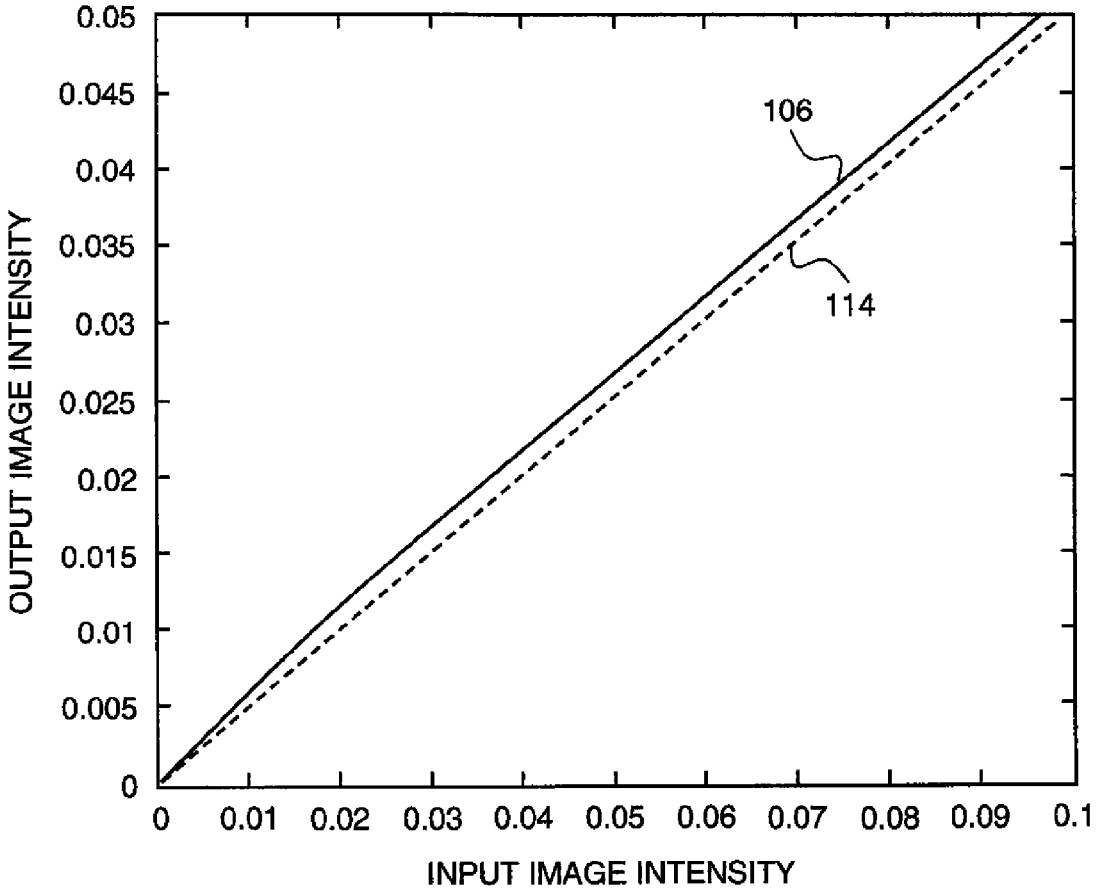
FIG. 8 is a graph showing a contrast function of the present invention as compared to a prior art function.

FIG. 8 shows a portion of the contrast function 106 corresponding to a proportion of the maximum luminance equal to 0.5, represented as a solid line. A portion of a linear transform 114 as known in the prior art for y1 equal to 0.5 is also shown. Note that contrast function 106 can appear to be very near linear. However, it actually includes two sub-functions, including a parabolic sub-function for low input image intensity values (typically less than 5%) and a linear sub-function for the remainder of the input image intensity values. Therefore, the contrast function diverges from linear for proportions of maximum luminance less than 1 and for low code values where the human eye is most sensitive to changes in luminance. This permits the output image intensity values to be increased more rapidly than can be achieved for a linear function with the same proportion of maximum luminance. The use of this nonlinear contrast function permits shadow detail to be maintained in the image as the peak frame luminance value is reduced.

Referring back to FIG. 5, once the contrast function is determined 56, this contrast function can be applied 58 to the input image signal to create a transformed image signal. This transformed image signal can then be modified using a relationship from linear intensity to display code value to create a drive signal, which can be provided 60 to the drive the display.

An attribute of this nonlinear transform is that the instantaneous slope at low input image intensity values can become larger than for the original image. This change can result in two potential artifacts. In areas of images having gradients in which the luminance varies slowly as a function of distance in the resulting image, false contour lines can be introduced. To avoid this artifact, the transform can be applied at a bit depth that is larger than the bit depth of the display and then reduced to a lower bit depth using techniques, such as blue noise dithering which introduces a low contrast, spatially varying, pattern to hide the presence of these contour lines. Therefore, the method of the present invention can further include dithering the second drive signals values in the shadow region.

A second possible outcome of this increase in the instantaneous slope is to increase the visibility of noise in the shadow regions of images. To avoid this artifact, when forming the second drive signals, the input image signal can be divided by filtering techniques known in the image-processing art into a high and a low spatial frequency image with the low frequency image having a maximum spatial frequency on the order of 4 cycles per degree of visual angle. The nonlinear transform can be applied 58 to only the low spatial frequency image and the more traditional linear transform can be applied to the high spatial frequency image. By performing this manipulation, the shadow detail can be enhanced in the low spatial frequencies of the images where this manipulation has the most visible impact without substantially increasing the instantaneous slope of the high spatial frequency components of the image, which typically contain unwanted image noise.

In displays, such as the EL display 12 shown in FIG. 2 which has four or more colors of emitters 14R, 14G, 14B, 14W, it is additionally possible to perform other manipulations of the color signal to reduce the power or image stick within the EL display system as the peak frame luminance value is decreased. For instance, the input image signal can undergo a transformation that reduces the saturation of colors within the input image signal and the degree of reduction can be dependent upon the number of static frames that are displayed contiguously (i.e., f).

For example, manipulations such as shown in the following equation can be applied to calculate a matrix that can be applied to the image data to reduce saturation in this way. Similar manipulations have been discussed by Miller et al. in U.S. Pat. No. 7,397,485.

In a specific example, a 3×3 desaturation matrix can be computed using the following equation:

$$dsmat = v\begin{bmatrix}1 & 0 & 0\\ 0 & 1 & 0\\ 0 & 0 & 1\end{bmatrix} + \frac{(v-1)}{100}\begin{bmatrix}L_r & L_g & L_b\\ L_r & L_g & L_b\\ L_r & L_g & L_b\end{bmatrix} \quad \text{(Eq. 4)}$$

In this equation the parameter v is calculated as a function of f and might, for instance, be computed as a difference between some large number of frames and f divided by the large number of frames, wherein the large number of frames is the number of frames over which all color saturation is to be lost. The values $L_r$, $L_g$, and $L_b$ represent the proportion of luminance that is produced by each of the red, green, and blue EL emitters to produce a color equal to the color of the white point of the display. This matrix can be multiplied by the matrix that is applied in step 72 to convert the input image signal to linear intensity when providing this conversion for the next frame of data. As such, the saturation of the image will be reduced as the image is dimmed. The saturation of the input image signal can therefore further be reduced continuously as a function of the number of increments over which the static image is displayed. As such, when the EL display has four-color channels, power consumption and burn-in can be further reduced when transforming the second frame using the dimming function of the present invention further includes reducing the saturation of the input image signals.

The invention has been described in detail with particular reference to certain preferred embodiments thereof, but it will be understood that variations and modifications can be effected within the spirit and scope of the invention.

In a preferred embodiment, the invention is employed in a display that includes Organic Light Emitting Diodes (OLEDs) which are composed of small molecule or polymeric OLEDs as disclosed in but not limited to U.S. Pat. No. 4,769,292, by Tang et al., and U.S. Pat. No. 5,061,569, by VanSlyke et al. Many combinations and variations of organic light emitting materials can be used to fabricate such a display. Referring to FIG. 2, EL emitters 14R, 14G, 14B and 14W can be OLED emitters, EL pixel 16 can be an OLED pixel, and EL display 12 can be an OLED display.

The input image signals and drive signals can be linear or nonlinear, scaled in various ways as commonly known in the art. The input image signals can be encoded according to the sRGB standard, IEC 61966-2-1. The drive signals can be voltages, currents, or times (e.g. in a pulse-width modulation "digital drive" system).

PARTS LIST

2 provide EL display step
4 receive input image signal step
6 transform first frame step
8 transform second frame step
10 provide drive signal to drive display step
12 EL display
14R red emitter
14G green emitter
14B blue emitter
14W white emitter
16 pixel
18 controller
20 input image signal
22 drive signal
30 demarcation line
32 first distribution of luminance values
34 second distribution of luminance values
36 maximum display luminance value
38 peak frame luminance value
42 proportion
52 receiving input image signal step
54 determine peak frame luminance step
56 determine contrast function step
58 apply contrast function
60 provide drive signal step
72 convert to linear intensity step
74 compute average linear intensity step

76 determine static image step
78 increment time step
80 calculate peak frame luminance step
82 determine dynamic image step
84 reset time step
106 contrast function
114 linear transform

The invention claimed is:

1. A method for controlling an electroluminescent (EL) display comprising a plurality of EL emitters to reduce burn-in on the display, the method comprising:

receiving a respective input image signal for each EL emitter for each of a plurality of frames;

transforming the input image signals for a first one of the plurality of frames to provide a plurality of first drive signals with a peak frame luminance to produce an image on the display; and transforming the input image signals for subsequent ones of the plurality of frames to a plurality of second drive signals using a dimming transform that operates on the input image signals for each subsequent frame to provide a peak frame luminance value for the subsequent frames wherein the dimming transform includes an exponential function, whereby:

the transform is applied when the first input image signal is recognized as requiring a current to achieve the peak frame luminance above a defined current threshold.

2. A method for controlling an electroluminescent (EL) display comprising a plurality of EL emitters to reduce burn-in on the display, the method comprising:

receiving a respective input image signal for each EL emitter for each of a plurality of frames;

transforming the input image signals for a first one of the plurality of frames to provide a plurality of first drive signals to produce an image on the display; and transforming the input image signals for subsequent ones of the plurality of frames to a plurality of second drive signals using a dimming transform that operates on the input image signals for each subsequent frame to provide a peak frame luminance value for the subsequent frames wherein the dimming transform includes an exponential function, whereby:

the transform is applied when the temperature of the display is recognized as exceeding a defined temperature threshold value.

* * * * *